US005642708A

United States Patent [19]

Heinrich et al.

[11] Patent Number: 5,642,708

[45] Date of Patent: Jul. 1, 1997

[54] METHOD OF MODIFYING THE MOTION OF AN OUTPUT-VARYING CONTROL ELEMENT

[75] Inventors: Axel Heinrich, Meine; Frank Schulze, Vordorf; Uwe Waschatz, Meine, all of Germany

[73] Assignee: Volkswagen AG, Wolfsburg, Germany

[21] Appl. No.: 636,838

[22] Filed: Apr. 23, 1996

[30] Foreign Application Priority Data

Apr. 29, 1995 [DE] Germany ..... 195 15 855.5

[51] Int. Cl.[6] ..... F02D 9/10; F02D 11/04

[52] U.S. Cl. ..... 123/357; 123/399

[58] Field of Search ..... 123/339.19, 339.21, 123/352, 361, 399, 478

[56] References Cited

U.S. PATENT DOCUMENTS

| | | | |
|---|---|---|---|
| 4,335,695 | 6/1982 | Phipps | 123/478 |
| 4,453,516 | 6/1984 | Filsinger | 123/399 X |
| 5,163,398 | 11/1992 | Buslepp et al. | 123/339.21 |

FOREIGN PATENT DOCUMENTS

| | | |
|---|---|---|
| 0352657 | 1/1993 | European Pat. Off. . |
| 3414681 | 10/1985 | Germany . |
| 3714342 | 11/1987 | Germany . |
| 3722088 | 1/1988 | Germany . |
| 3842075 | 6/1990 | Germany . |
| 3930396 | 3/1991 | Germany . |
| 4108956 | 9/1991 | Germany . |

*Primary Examiner*—Tony M. Argenbright

*Attorney, Agent, or Firm*—Brumbaugh, Graves, Donohue & Raymond

[57] ABSTRACT

A method of modifying the motion of an output-varying control element of an internal combustion engine for a motor vehicle includes detecting the position of the gas pedal and, depending on the position of the gas pedal, determining a control parameter for the output-varying control element. For a particular setting of the output-varying control element the output increment per cycle is prospectively determined, at least as a function of operating parameters of the engine, and from this optimal value and the control parameter determined according to the gas pedal position, a parameter is computed for the output varying control element in the ensuing cycles.

10 Claims, 2 Drawing Sheets

METHOD OF MODIFYING THE MOTION OF AN OUTPUT-VARYING CONTROL ELEMENT

BACKGROUND OF THE INVENTION

This invention relates to methods for modifying the motion of an output-varying control element of, for example, a motor vehicle engine, wherein the position of a gas pedal is detected and a parameter is produced for controlling an output-varying control element as a function of the position of the gas pedal. The output-varying control may, for example, be a throttle flap in an intake duct or it may be a servo device controlling the fuel flow rate.

When the motion of an output-varying control element is modified proportionally to the actuation of the gas pedal by the operator of a motor vehicle, the problem arises that, if the opening of the throttle flap, for example, is too rapid, combustion of fuel in the combustion chamber of the engine will be incomplete. This leads in turn to increased emission of pollutants and to unnecessarily high fuel consumption. On the other hand, in certain cases if the response of the output-dependent control element is too slow a jerky increase or reduction in the output of the engine may be produced, with an adverse effect on riding comfort.

To solve this problem, German Offenlegungsschrift No. 41 08 956 describes a device for retarding the motion of an output-varying control element in which the gas pedal and the output-varying control element, i.e., a throttle flap or servo element controlling the fuel flow rate, are coupled by a pressure device which retards the motion of the control element relative to the actuation of the gas pedal.

The pressure device includes a cylinder housing connected to the gas pedal and a piston guided in the cylinder and connected to the throttle flap. The pressure chamber so formed communicates with the negative pressure in the intake duct behind the throttle flap and also with the ambient pressure through an adjustable restricted opening.

When the vehicle is accelerated by moving the gas pedal, the negative pressure in the pressure chamber is reduced by the cylinder motion and, as equilibrium is reached between the intake duct pressure and ambient pressure supplied through the restricted opening, the piston element will follow the cylinder motion, so that the throttle flap opens completely.

Beside having the disadvantage of a mechanical structure requiring additional space, this arrangement does not provide for adjustment of the retardation of the control element motion as a function of other parameters of the engine. It is doubtful also whether a controlled proportioning of fuel to obtain a stoichiometric fuel-air ratio is possible with such an adjustment of the intake air supply.

SUMMARY OF THE INVENTION

Accordingly, it is an object of the present invention to provide a method of modifying the motion of an output-varying control element which overcomes the disadvantages of the prior art.

Another object of the invention is to provide a method of modifying the motion of an output-varying control element of an internal combustion engine wherein the modification can be predetermined in a defined manner as a function of several different parameters, and wherein the degree of readjustment of the control element, and hence the air flow to be introduced into the combustion chamber or the quantity of fuel to be injected in the case of a Diesel engine, are determined by a parameter which is a function of the position of the gas pedal.

These and other objects of the invention are attained by modifying the motion of an output-varying control element of an internal combustion engine at least as a function of the engine load and the rotational speed of the engine to provide an optimum value of output variation for each stroke of the engine. From this optimal value for the output variation and from the parameter obtained as a function of the gas pedal position, a combined parameter is generated for the output-varying control element in the ensuing engine cycles.

In addition to the operating parameters of the engine, parameters representing roadway conditions may also be included in the determination of optimal values for control element output variation, in order, for example, to prevent the wheels from spinning. Also, parameters representing the habits of a person who operates the vehicle frequently may be included. This may be accomplished, for example, by a learning operation in which it is ascertained whether the individual tends to drive in a sporting manner or instead with minor variations of output. However, it is also possible to provide a selector switch for that purpose.

If the output-varying control element is an adjusting device arranged in an air supply conduit for an internal combustion engine, for example a throttle flap arranged in an intake duct, and if a parameter for the air flow to be adjusted by the control element is obtained as a function of the position of the gas pedal, then an optimal air flow variation is determined prospectively as the optimum value for the output change. From the optimal air flow change and the control parameter for the air flow, a parameter is computed for the servo device which adjusts the air flow for the ensuing cycles. Each air supply conduit has a time behavior of its own because of its geometrical configuration and the lag of certain moving parts. Consequently, it is advantageous to take account of the flow characteristics of the air supply conduit for the air flow in the advance computation of the parameter for the servo device which controls the air flow, for example the throttle flap.

Since the air flow to be introduced for each successive cycle is known, it is also possible to calculate the fuel flow rate required to maintain a stoichiometric fuel-air mixture and to then inject the fuel in a controlled manner.

In engines in which the output-variable control element is a servo device which controls a quantity of fuel to be injected and a control parameter for the quantity of fuel to be injected is obtained as a function of the position of the gas pedal, an optimal fuel flow rate variation per cycle is prospectively determined as an optimal value for the output variation at least as a function of the operating parameters of the engine. From this optimal fuel flow rate variation and from the control parameter for the quantity of fuel to be injected, a parameter is computed for the servo device which controls the fuel flow rate for the ensuing engine cycles.

With the method of the invention, abrupt alternations of load due to an over-rapid response of the output-variable control element are prevented. When account is taken of roadway conditions by utilizing a corresponding parameter, for example wheel slip, an anti-slip control can also be achieved in simple manner. Furthermore, for dynamic processes such as acceleration, it is possible to reduce fuel consumption as well as emission of pollutants without reduction of power output.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
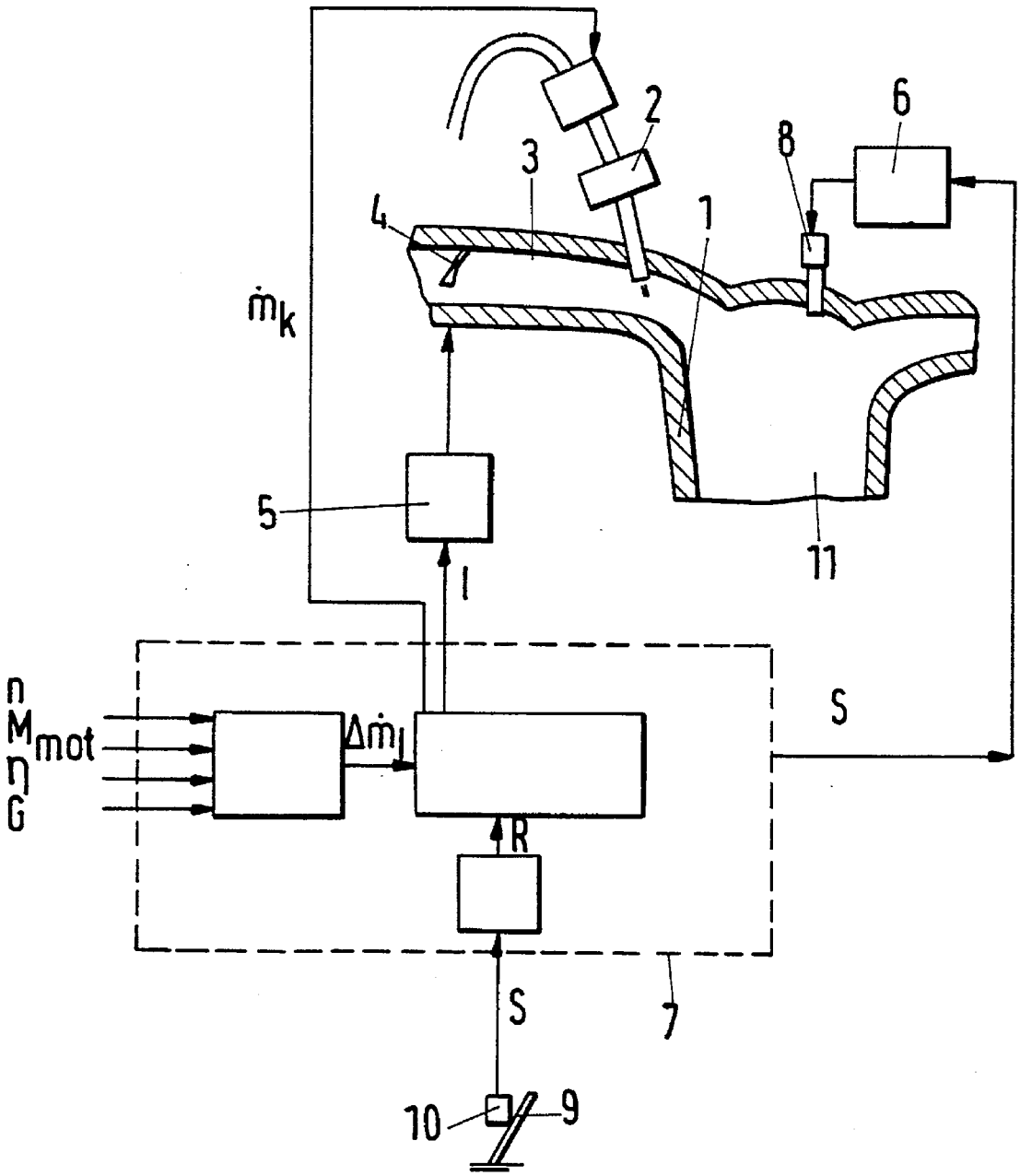
FIG. 1 is a schematic diagram illustrating a representative embodiment of a control system for carrying out the method according to the invention.

In the typical embodiment shown in FIG. 1, a cylinder 1 of an internal combustion engine is supplied with a fuel injection valve 2 in an intake duct 3. However, it will be understood that the method of the invention is also applicable to internal combustion engines having direct fuel injection. The supply of fresh air to adjust the fuel-air ratio in the intake duct 3 is controlled by a throttle flap 4 having an aperture angle $\alpha$ which is adjusted by a servo device 5, for example a step motor, in accordance with selected parameters to generate a defined air flow rate $\dot{m}_1$ in the intake duct 3. An ignition control unit 6 transmits an ignition signal to a spark plug 8 in accordance with a unit control signal $S_{zünd}$ received from a control unit 7 in order to cause ignition at a selected time, when a predetermined fuel-air ratio, likewise controlled by the control unit, is present in the combustion chamber of the cylinder 1.

In addition, the position of a gas pedal 9, actuated by the operator of the vehicle, is detected by a sensing device 10 which produces a corresponding electrical signal $S_{pedal}$. The sensing device 10 may, for example, be a potentiometer integrated with the gas pedal so as to produce the electrical signal $S_{pedal}$ as a function of the gas pedal position. In accordance with the signal $S_{pedal}$ representing the gas pedal position, the control unit 7 generates a parameter R for the servo device 5 driving the throttle flap 4. The parameter R is supplied directly to the servo device 5 for adjustment of the throttle flap angle proportionally or as a damped function in a conventional manner. For certain operating parameters of the engine, however, this may lead to abrupt output fluctuations that adversely affect riding comfort. In certain roadway conditions, for example extreme smoothness or slipperiness, an excessive torque so generated will cause the wheels to spin and the torque required to cause such spinning may be used to determine a roadway condition parameter $\eta$.

Each intake duct 3 has a time behavior of its own, so that, as a result of the direct transmission of the gas pedal position to the servo device 5 for the throttle flap 4 a stoichiometric fuel-air ratio is difficult to establish in the combustion chamber 11 of the cylinder during dynamic processes such as acceleration. Instead, the fuel-mixture will become either too lean or too rich. For this reason, according to the invention, the control unit 7 is supplied with selected operating parameters of the engine including, in this embodiment, the rotational speed n and the load $M_{mot}$ of the engine, the roadway condition parameter $\eta$, and the gear speed G. However, parameters for still other variable characteristics may also be supplied. For these parameters or characteristics, the control unit 7 prospectively computes an optimum air flow increment $\Delta\dot{m}_1$ per engine cycle. Alternatively, the optimum air flow increment $\Delta\dot{m}_1$ may be stored in the control unit 7 as a function of selected operating conditions of the engine.

From the optimum air flow increment, in combination with the control parameter R for the air flow rate $\dot{m}_1$, obtained from the change in position of the gas pedal 9, a parameter $I_{drossel}$ is obtained for the device 5 to adjust the throttle flap 4.

To take account of the time behavior of the intake duct 3 in calculating the parameter $I_{drossel}$, the air flow characteristics of the intake duct 3 are introduced into the calculation. Since the air flow characteristics of the intake duct vary during the life of the engine, this variation is also taken into account in the form of a modification of the variation of the change of load with time, i.e., the variation in the air-fuel rate taken in by the engine, in the form of a modification based on tolerances and aging processes. Thus it is known prospectively for the ensuing cycles of the engine what quantity of air will actually be supplied to each of the combustion chambers 11. The fuel flow rate $\dot{m}_k$ required to produce a stoichiometric fuel-air ratio can thus be computed in a defined manner by the control unit 7.

Figure 2:
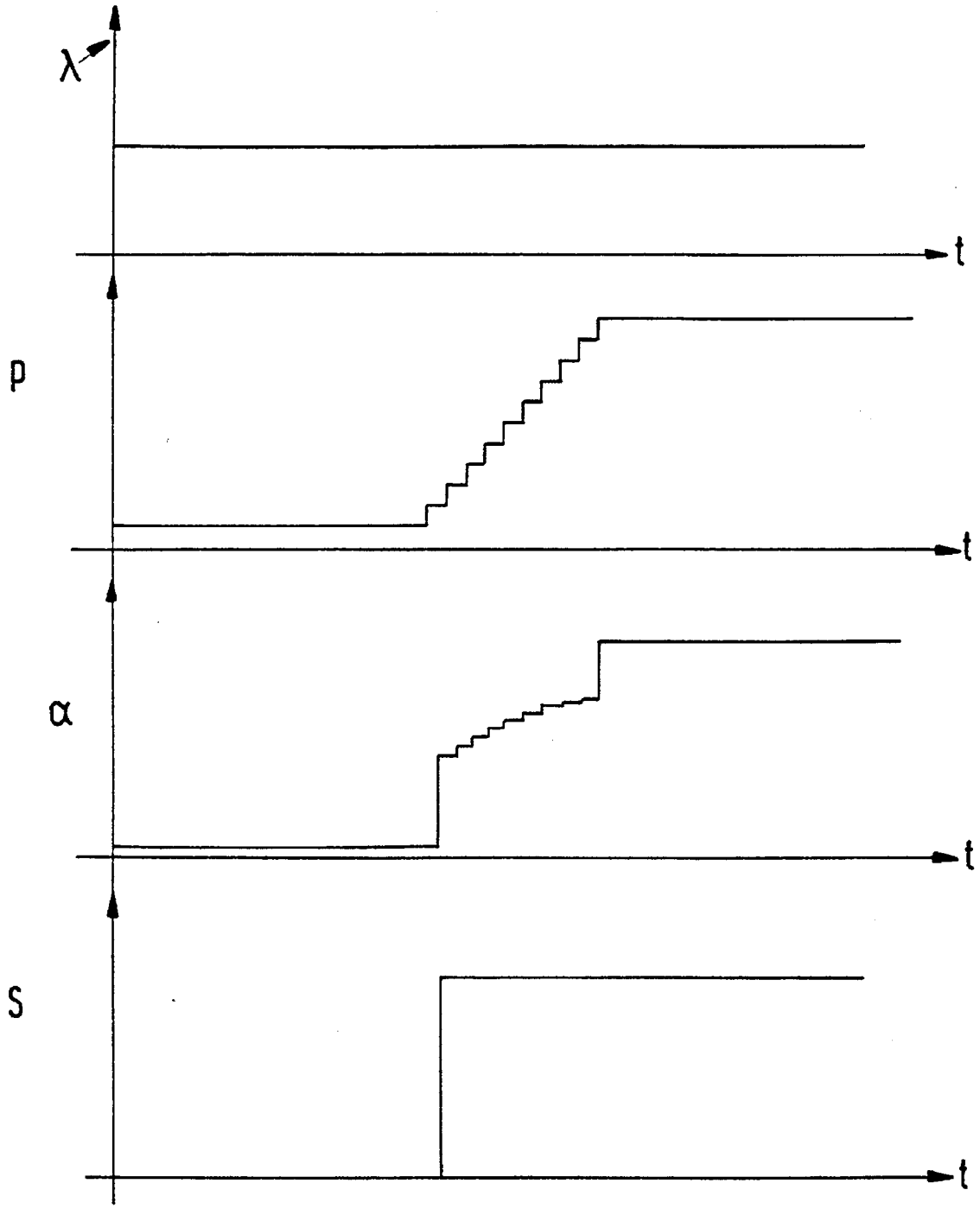
FIG. 2 is a graphical representation showing the throttle flap angle, the resulting intake pressure, and the fuel-air ratio of the engine, as functions of the gas pedal actuation signal.

To illustrate the effect obtained by the method of the invention, FIG. 2 shows the throttle flap angle $\alpha$ as modified according to the method, the correspondingly generated intake pressure $P_{saug}$, and the fuel-air ratio $\gamma$ as functions of the signal representing the position of the gas pedal $S_{pedal}$ during an acceleration resulting from an abrupt actuation of the gas pedal. The large increase in throttle flap angle $\alpha$ at the beginning of actuation of the throttle flap in this case results from allowance for the air flow characteristics of the intake duct.

Although the invention has been described herein with reference to specific embodiments' many modifications and variations therein will readily occur to those skilled in the art. Accordingly, all such variations and modifications are included within the intended scope of the invention.

We claim:

1. A method of modifying the motion of an output-varying control element of an internal combustion engine for a motor vehicle, wherein the position of a gas pedal is detected and, depending on the position of the gas pedal, a control parameter for the output-varying control element is determined, comprising the steps of determining prospectively an optimal value for the output variation of the engine per cycle at least as a function of selected operating parameters of the engine, and obtaining a control parameter for modifying the output-varying control element for ensuing cycles based on an optimal value of the output variation and using the control parameter to control the motion of the output-varying control element.

2. A method according to claim 1 including using a parameter representing a roadway condition in the computation of the optimal value for the output variation per cycle of the engine.

3. A method according to claim 1 including using a parameter representing habits of a person operating the motor vehicle in the computation of the optimal value of the output variation per cycle of the engine.

4. A method according to claim 1 including using a parameter representing a gear speed of a transmission connected to the engine in the computation of the optimal value for the output variation per cycle of the engine.

5. A method according to claim 1 wherein the output-varying control element is a servo device arranged in an air supply conduit of the internal combustion engine and including the steps of determining a control parameter for an air flow rate to be set by the servo device as a function of the position of the gas pedal, prospectively determining an optimal air flow rate increment per cycle as the optimal value for the output variation as a function of the operating parameters of the engine and computing, from the optimal air flow rate increment and the control parameter for the air flow rate, a parameter for the control of the servo device to adjust the air flow rate for ensuing cycles.

6. A method according to claim 5 wherein the parameter for control of the servo device is determined from the optimal air flow rate increment per cycle and from the control parameter for the air flow rate with allowance for the air flow characteristics of the air supply conduit.

7. A method according to claim 5 wherein the parameter for the servo device is determined from the optimal air flow rate increment per cycle and the control parameter for the air flow rate is determined with allowance for the variation of load alternation with time.

8. A method according to claim 5 wherein the air supply conduit is an intake duct and the servo device for controlling the air flow rate is a throttle flap.

9. A method according to claim 5 wherein a quantity of fuel per cycle to be injected into the combustion chamber is determined according to the air flow rate to be expected from the optimal air flow rate increment.

10. A method according to claim 1 wherein the output-varying control element is a servo device for adjusting a quantity of fuel to be injected and including the steps of determining a control parameter for the quantity of fuel to be injected according to the position of the gas pedal, prospectively determining an optimal fuel flow rate increment per cycle as an optimal value for the output variation as a function of the operating parameters of the engine, and computing from the optimal fuel flow increment and the control parameter for the quantity of fuel to be injected a parameter for the servo device controlling the fuel flow rate for the ensuing cycles.

* * * * *